United States Patent [19]

Hoehing et al.

[11] 4,140,473

[45] Feb. 20, 1979

[54] APPARATUS AND METHOD TO CONTROL PROCESS TO REPLACE NATURAL GAS WITH FUEL OIL IN A NATURAL GAS BURNER

[75] Inventors: William W. Hoehing, Houston, Tex.; John M. Jackson, Louisville, Ky.; Edward R. Johnson, Hopewell, Va.

[73] Assignee: Allied Chemical Corporation, Morristown, N.J.

[21] Appl. No.: 758,968

[22] Filed: Jan. 13, 1977

[51] Int. Cl.[2] ..... F23D 11/44

[52] U.S. Cl. ..... 431/11; 431/36

[58] Field of Search ..... 431/11, 12, 5, 4, 211, 431/208, 89, 36, 37, 41; 208/361, 131; 203/88, 347; 236/14, 15 E, 15 R; 252/373

[56] References Cited

U.S. PATENT DOCUMENTS

| | | | |
|---|---|---|---|
| 1,959,031 | 5/1934 | Masters | 431/11 |
| 3,711,457 | 1/1973 | Ayres | 203/88 X |
| 3,885,904 | 5/1975 | Feng | 431/11 |
| 4,025,282 | 5/1977 | Reed et al. | 431/11 |

*Primary Examiner*—Edward G. Favors
*Assistant Examiner*—Larry Jones
*Attorney, Agent, or Firm*—Michael S. Jarosz

[57] ABSTRACT

An apparatus and method to control a process to replace natural gas with vaporized fuel oil whereby fuel oil is mixed with a gaseous diluent and partially vaporized, liquids separated out, superheated and burned in a natural gas burner without major modification to the burner is disclosed. The control system is:

1. a liquid level controller sensing the liquid level in the separator to automatically control the flow of the fuel oil to the vaporizer,
2. a ratio flow controller sensing the flow of the fuel oil and of the diluent to the vaporizer to automatically control the flow of the diluent to a set ratio of the flow of the fuel oil,
3. a pressure controller sensing the pressure at the vaporizer outlet and downstream overhead to automatically control the heat input to the vaporizer and optionally,
4. a flow control valve set to automatically control the flow of the separator overhead to the burner; also,
5. a temperature controller sensing the temperature of the vapor effluent from the superheater to automatically control the heat input to the superheater.

The vaporized fuel-diluent should be superheated to 50–300° F. above the dew point of mixed vapor, preferably 100–275° F. above. The fuel-diluent mixture should be at a steady pressure value between about 5 and 80 psig. as feed to the burner. The preferred diluent is steam.

41 Claims, 5 Drawing Figures

APPARATUS AND METHOD TO CONTROL PROCESS TO REPLACE NATURAL GAS WITH FUEL OIL IN A NATURAL GAS BURNER

BACKGROUND OF THE INVENTION

This invention relates to an apparatus and method to modify and vaporize liquid hydrocarbons so that they may be burned in a conventional gas burner, more particularly the method is to mix fuel oil with diluent, such as steam, partially vaporize the fuel oil, separate out liquid, superheat the vapor and burn it in a burner designed for natural gas without major modifications to the burner.

This invention is an improvement on the invention in copending application Ser. No. 758,586, of even date, which in turn is a continuation-in-part application of application Ser. No. 549,641, filed Feb. 13, 1975 now abandoned, hereby incorporated by reference.

The general concept of mixing oil and steam to vaporize, and subsequently superheating the mixture, then burning it, is very old as shown in U.S. Pat. Reissue No. 10,699 (1886); U.S. Pat. No. 1,719,397 (1929); and U.S. Pat. No. 1,971,847 (1934).

Also, the general concept of separating liquid from vapor in the effluent of a vaporizer with recirculation of a portion of a separator bottoms to the vaporizer, and with another portion of the separator bottoms drawn off, is old as shown in U.S. Pat. No. 1,842,320 (1932), and U.S. Pat. No. 2,799,628 (1957).

The concept of mixing a diluent gas into a vaporized oil is also disclosed in the prior art such as in U.S. Pat. No. 3,561,895 and in U.S. Pat. No. 1,958,671.

Flashing of liquid (not vapor) oil is known; see U.S. Pat. No. 2,067,940.

Also, it is disclosed in many patents, such as U.S. Pat. No. 3,291,191 and U.S. Pat. No. 3,885,904, mixing oil vapor with air and/or products of oil combustion prior to the burner in order to use normally liquid fuel in conventional gas burners. This explosive mixture is not part of the inventive concept of this patent application.

In U.S. Pat. No. 3,938,934, the concept of warming the air or combustion with warm water to be cooled by means for evaporative cooling such as a cooling tower is disclosed.

In U.S. Pat. No. 3,049,168, the disclosure is limited to simultaneous burning of two fuels from two separate burners, one for each fuel.

The following U.S. patents disclose various control systems for gas burners. U.S. Pat. No. 3,722,811 is directed to a complex control system for a burner. The system controls the flow of two separate fuels and air through a computing relay which computes the heat value of the fuel and also uses a three-way valve receiving signals from measuring devices on the second fuel line and a by-passing conduit hooked to the second fuel line, with all the fuel, air and by-passing conduit flows being measured and monitored in the complex signaling means system. U.S. Pat. No. 3,561,895 discloses feeding fuels of different molecular weights to a burner having constant air flow. This patent discloses the steps of determining the variations and density of the second fuel and adjusting the temperature of the second fuel to equalize the density of the second fuel with the first so as to maintain constant air flow at the burner even though fuels are changed. U.S. Pat. No. 3,291,191 discloses a method of operating a gas burner in interruptable service. The method is (a) terminating the flow of gas, (b) supplying a light petroleum hydrocarbon and (c) mixing the hydrocarbon with air and burning the hydrocarbon. The light hydrocarbon must have an end boiling point not exceeding about 450° F. U.S. Pat. No. 3,285,320 has a disclosure limited to a control system which varies the flow of the fuel in accordance with the specific gravity or varies the flow with the specific gravity plus the Btu value. U.S. Pat. No. 3,049,300 is limited to controlling the combustion zone in a two-fuel furance, such as a blast furnace, to achieve excess air in the stack.

The prior art also teaches the use of steam to atomize oil such as in U.S. Pat. No. 1,766,243 or U.S. Pat. No. 132,440 (1872). The latter patent also superheats the atomized or vaporized oil. For purposes of this patent application, vaporization shall mean changing the liquid fuel oil to a vapor, not merely physically breaking it up into droplets or a fog such as disclosed in the "atomizing" prior art.

The following U.S. patents are of some interest: U.S. Pat. Nos. 3,897,194; 3,614,282; 2,070,209; 3,885,904; 3,463,599; 1,987,400; 3,850,569; 3,236,281; 1,843,757; 3,876,363; 3,159,345; 1,337,144; 3,808,795; 3,107,719; 1,158,687; 3,749,318; 2,975,594; 1,466,250; 3,672,808; 2,972,058; 3,649,230; 2,866,602.

SUMMARY

It is essential that vaporized fuel oil mixtures be supplied to the burner fuel headers at a controlled pressure and temperature. Both pressure and temperature must be maintained within specific limits to ensure optimum burner flame characteristics and to permit regulation of the fuel flow or heat input to the furnace or heater being fired.

It has been found that operation of the fuel header below a minimum pressure at a critical value, different for different burners, and different mixtures results in a sparking burner flame indicative of incomplete burning in the normal flame combustion zone. When the pressure of the vaporized fuel oil mixture in the fuel header fluctuates, it is not possible to accurately regulate the fuel flow to the burners by usual control methods.

Also, the vaporized fuel mixtures must be superheated sufficiently so that no hydrocarbon is condensed in the fuel header. Liquids cause incomplete combustion, sparking and yellow streaks in the flame.

These problems of poor burner flame characteristics are overcome by the specific control systems and operating parameters of this invention.

One aspect of this invention is a method to replace natural gas with vaporized fuel oil for burning in a natural gas burner without major modifications to the burner. The method comprises mixing fuel oil with a gaseous diluent, then vaporizing a portion of the fuel oil in the mixture of fuel oil and diluent in a vaporizer, then separating the vapor portion from the liquid portion of the partially vaporized fuel oil as overhead effluent vapor in the separator and maintaining this vapor at a high temperature and pressure with heat from the vaporizer, while controlling the temperature, pressure and/or flow rates of the mixing, vaporizing and separating. This controlling is done by (a) automatically controlling the flow of the fuel oil with a liquid level controller sensing the liquid level in the separator, (b) automatically controlling the flow of the diluent with a ratio flow controller sensing the flow of fuel oil and of the diluent to the vaporizer to control the flow of the diluent to a set ratio of the flow of the fuel oil, (c) automatically controlling the vaporizing heat input to the vaporizer with a pressure controller sensing the pressures of the vaporizer outlet and separator overhead, and (d) controlling the flow of the separator overhead with a valve, preferably automatically, and more preferred controlled by a set flow controller. In this mode of operation, the mixture of diluted vaporized fuel oil is maintained at high temperature and pressure by the heat of the vaporizer and "flashed" across the valve controlling the flow of the separator overhead vapor to a lower temperature and pressure before it is burned.

In this same mode of operation it is preferable to maintain the vaporized fuel and diluent exiting the control valve at a temperature of between about 50° F. to 300° F. above the dew point of the mixture and maintaining the separation and vaporization at a pressure of between about 75–150 psig. above the pressure downstream of the valve controlling the separator overhead. This mixture is then burned in the burner.

In another mode, the method uses superheating of the overhead effluent from the separator. This method is also to replace natural gas with vaporized fuel oil for burning in at least one natural gas burner, without major modifications to the burner. This method comprises mixing fuel oil with a gaseous diluent, then vaporizing a portion of the fuel oil in the mixture of fuel oil and diluent in a vaporizer, then separating the vapor portion from the liquid portion of the partially vaporized fuel oil as overhead effluent in a separator, then superheating the overhead effluent from the separator, while controlling the temperature, pressure and/or flow rates of the mixing, vaporizing, separating and superheating. This controlling is done by (a) automatically controlling the flow of the fuel oil with a liquid level controller sensing the liquid level in the separator, (b) automatically controlling the flow of the diluent with a ratio flow controller sensing the flow of the fuel oil and the diluent to the vaporizer to control the flow of the diluent to a set ratio of the flow of the fuel oil, (c) automatically controlling the vaporizing heat input to the vaporizer with a pressure controller sensing the pressure of the vaporizer outlet and separator overhead, (d) controlling the flow of the superheater effluent with a valve, preferably automatically and more preferred, controlled by a set flow controller, and preferably (e) automatically controlling the heat input to the superheater with a temperature controller sensing the temperature of the superheater overhead effluent.

Preferably, the superheating is carried out to heat the overhead effluent from the separator to a temperature above between about 50° F. to 300° F. of the dewpoint of the overhead effluent from the superheater. This overhead effluent is the mixture of diluted fuel oil vapor which is then burned in the burner. Even more preferably, the temperature is between about 100° to 275° F. above the dewpoint. Preferably, the superheating takes place at a pressure of between about 15 to 85 psig. Also, the pressure downstream of the valve automatically controlling the flow of the superheater overhead is preferably steady at a value of between about 5 and 80 psig.

It is preferred that the valve automatically controlling the flow of the superheater overhead is controlled by a flow recorder-controller set to sense and automatically control the flow.

In a preferred embodiment the diluent is also superheated before being added to the fuel oil. Superheating is preferably accomplished by heat exchange with waste heat from the vaporizer, and even more preferably, the vaporizing is accomplished by burning a fuel and heat exchange is accomplished by passing hot combustion gases from the same burning (to heat the vaporizer) across the heat exchanger. This heat exchanger can be located as a coil in the vaporizer exhaust stack. Preferably, the heat exchanger is a coil disposed within or around a cylinder in the exhaust stack of the vaporizer and the cylinder has an internal damper automatically controlling the temperature of the superheated diluent by sensing its temperature with a temperature controller which automatically opens and closes the damper.

The preferable diluent is selected from the group consisting of steam, natural gas, purge gas, low Btu fuel gas, and mixtures thereof, and most preferred is steam.

Also, the combustion air supplied to the natural gas burner is preferably preheated in both modes of operation. This preheating can be accomplished by heat exchange with waste heat, preferably from combustion gases from a burned fuel. Even more preferably, the combustion gases are flue gases from the former natural gas burner.

It is preferable that at least a portion of the separator bottoms is drawn off (blowdown) to storage in order to remove nonvaporized accumulated metals and sulfur impurities from the fuel oil being fed to the vaporizer. This is true for both of the above modes of operation. Also, a preferable embodiment is wherein, in addition to the separator bottoms being drawn off to storage, another portion of the separator bottoms is recycled to pass through the vaporizer. Since the fuel oil is only partially vaporized, either blowdown or recirculation or both is essential in order to accommodate the liquid accumulation in the separator.

In a broad aspect, the apparatus of this invention is an apparatus to replace natural gas with vaporized fuel oil, whereby the fuel oil is mixed with a gaseous diluent and partially vaporized to burn in at least one natural gas burner without major modifications to the burner. The apparatus comprises an oil vaporizer, a gas liquid separator, a source of fuel oil under pressure, a source of diluent under pressure, a source of heat for the vaporizer, and a control system to control the temperature, pressure and/or flow rates into and out of the vaporizer and the separator. The fuel oil and diluent are admixed and introduced into the vaporizer, the effluent from the vaporizer is introduced to the separator, and the overhead effluent to the separator is burned in the former natural gas burner. The control system comprises a liquid level controller sensing the liquid level in the separator to automatically control the flow of fuel oil to the vaporizer, a ratio flow controller sensing the flow of the fuel oil and of the diluent to the vaporizer to automatically control the flow of the diluent to a set ratio to the flow of the fuel oil, a pressure controller sensing the pressure at the vaporizer outlet and separator overhead to automatically control the heat input to the vaporizer, and a flow control valve set to automatically control the flow of the separator overhead to the former natural gas burner.

In another aspect using a superheater, the apparatus of this invention is an apparatus to replace natural gas with vaporized fuel oil, whereby the fuel oil is mixed with a gaseous diluent and partially vaporized to burn in at least one natural gas burner without major modifications to the burner. The apparatus comprises a source of fuel oil under pressure, a source of diluent under pressure, an oil vaporizer, a gas-liquid separator, a vaporizer effluent superheater, a source of heat for the vaporizer, a source of heat for the superheater and a control system to control the temperature, pressure and/or flow rates into and out of the vaporizer, separator and superheater. The fuel oil and diluent are admixed and introduced into the vaporizer with the effluent from the vaporizer being introduced into the separator, the overhead effluent vapor from the separator being introduced into the superheater and the effluent from the superheater being burned in the burner. The control system comprises a liquid level controller sensing the level of liquid in the separator to automatically control the flow of the fuel oil to the vaporizer, a ratio flow controller sensing the flow of the fuel oil and the diluent to the vaporizer to automatically control the flow of the diluent to a set ratio of the flow of the fuel oil, a pressure controller sensing the pressure at the vaporizer outlet and separator overhead to automatically control the vaporizing heat output to the vaporizer, and preferably a flow recorder controller set to automatically control the flow of the vapor effluent from the superheater to the burner with a control valve.

Preferably, the control system also has a temperature controller sensing the temperature of the superheater vapor effluent to automatically control the heat input into the superheater. In another preferred embodiment, the apparatus also comprises a diluent superheater. The diluents are preferably selected from the group consisting of steam, natural gas, purge gas, low Btu fuel gas, and mixtures thereof, and most preferably steam.

It is preferred to preheat the combustion air to the natural gas burner with a preheater. This is true with both of the above embodiments.

It has also been discovered that good flame characteristics, depending on the pressure in the header to the burner, requires a spud in the burner of a critical orifice size. It appears that using a spud in the natural gas burner having a Morse Taper Drill number of 30 or less is suitable for both low and high pressures. However, at pressures above 50 psig the Morse Taper Drill number of the spud in the natural gas burner must be 36 or smaller. When the pressure downstream of the automatic valve controlling the flow of vapor effluent from the superheater is above 67 psig, the Morse Taper Drill number of the spud must be 46 or smaller.

The preferred pressure in the fuel header to the burners, i.e., downstream of the valve controlling flow of the superheater effluent or the separator effluent is between about 10 to 70 psig.

By properly controlling the temperature, pressure and flow rates with and in the apparatus of this invention, fuel oil may be diluted, vaporized, and burned in a natural gas burner, without major modifications to the burner, to achieve a clear, blue, uniform flame, similar in characteristics to a natural gas flame. The actual temperature, pressure, and flow conditions to achieve a good flame will necessarily vary with the heat load required, the type of burner used, the type of furnace being fired, i.e., downdraft, radiant wall, etc., the particular characteristics of the fuel and diluent and many other variables.

DESCRIPTION OF PREFERRED EMBODIMENTS

Like numbers reference like elements in all the drawings.

Figure 1:
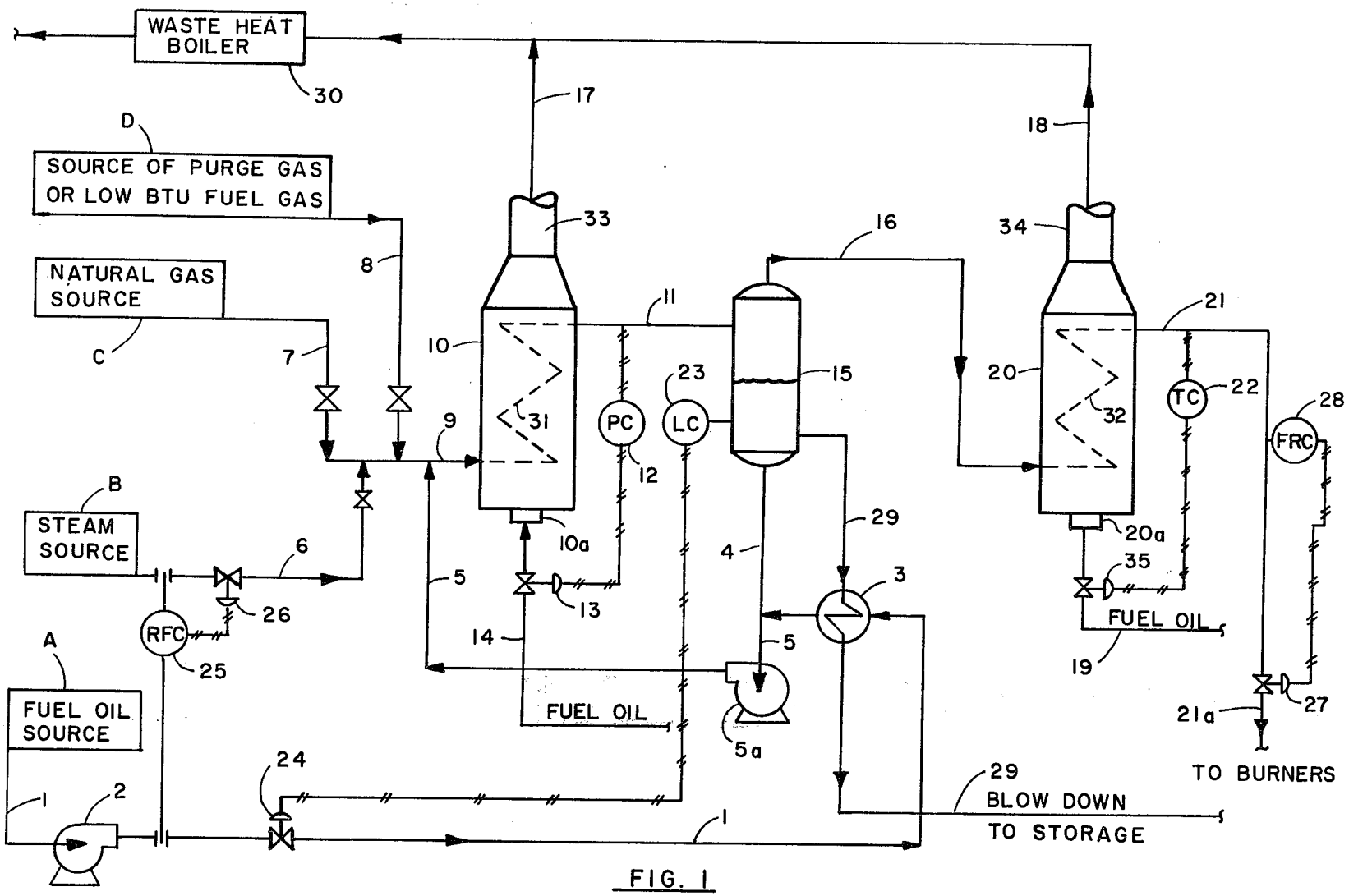
FIG. 1 is a schematic showing the apparatus of this invention and illustrating the method.

In FIG. 1, the main elements of the schematic of the apparatus and flow sheet are a source of fuel oil A, a steam source B, natural gas source C, source of purge gas or low Btu fuel gas D, the vaporizer 10, separator 15, and superheater 20. Fuel oil from fuel oil source A flows through line 1 to pump 2 and further through line 1 to be heated by heat exchanger 3 and combined with separator 15 bottoms through line 4, combined fresh fuel oil and separator bottoms then flow through line 5 to be pumped by pump 5A through line 5 to vaporizer feed header 9. Also, steam from a supply of steam under pressure from steam source B flows through line 6 to vaporizer fuel header 9. Additionally, or alternatively, a supply of natural gas under pressure from natural gas source C flows through line 7 to vaporizer feed header 9 and/or a flow of purge gas or low Btu fuel gas under pressure flows from its source D through line 8 into vaporizer feed header 9. Then the fuel oil in the mixture of fuel oil with diluent from source B, C and/or D, preferably steam, is partially vaporized in vaporizer 10 by heat furnished from a source of heat, such as burner 10A, burning fuel oil through line 14. The combustion gases from vaporizer 10 pass through vaporizer exhaust stack 33 and vaporizer flue gas line 17 to waste heat boiler 30. The heat from burner 10A partially vaporizes the fuel oil in the vaporizer coil 31, then the vaporizer effluent passes through line 11 to separator 15. The heat input to vaporizer 10 is controlled by pressure controller 12 automatically controlling valve 13 in fuel line 14 to burner 10A. The liquid portion of vaporizer effluent from line 11 is separated out in separator 15 and flows through line 4 to be recycled back to vaporizer 10 and also flows through line 29 as blowdown to storage. This blowdown to storage through line 29 removes the accumulated nonvaporized metal and sulfur impurities. The overhead effluent vapor from separator 15 flows through line 16 to superheater 20. Superheater 20 also has a source of heat such as burner 20A fueled by fuel oil through line 19. Burner 20A heats the separator effluent in superheater 20 by heating coils 32. Combustion gases from superheater pass through superheater stack 34 and superheater flue gas line 18 to waste heat boiler 30. The superheated vapor effluent from coil 32 passes through effluent line 21 and on to natural gas burners shown in FIG. 3 through line 21A, the fuel header to the burners. The flow of vaporized fuel oil through line 21 is controlled by vaporized fuel oil valve 27 which is automatically controlled by the flow recorder controller 28. The heat input to the superheater is controlled by temperature controller 22 automatically controlling valve 35 in fuel oil line 19 to burner 20A. The flow of original fuel oil from source A through line 1 is controlled by liquid level controller 23 sensing the liquid level in separator 15 and automatically controlling fuel oil supply valve 24. The flow of steam from source B through line 6 is controlled by ratio flow controller 25 automatically controlling valve 26. Ratio flow controller 25 senses the flow of both the fuel oil and the steam to vaporizer feed header 9. The flow of steam through line 6 is controlled to a set ratio of the flow of fuel oil through line 1.

Figure 2:
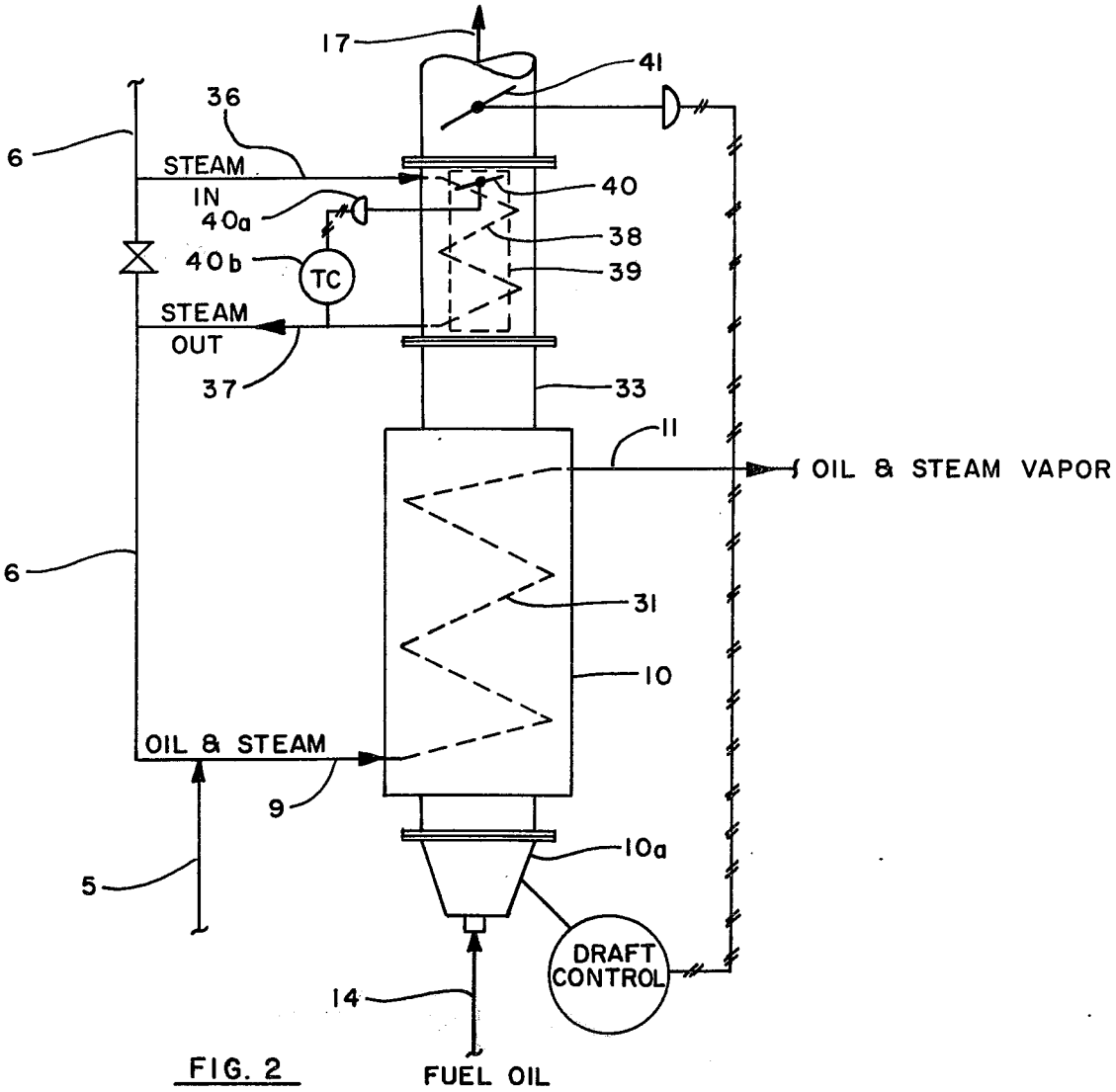
FIG. 2 is a schematic of the vaporizer of this invention, showing the preferred embodiment of the steam superheater in the stack thereof.

In FIG. 2, the preferred embodiment is shown whereby the diluent, such as steam, is preheated. Specifically, steam from line 6 is fed through line 36 to steam superheater coil 38 in stack 33 of vaporizer 10. The superheated steam exits coil 38 through line 37 to return to line 6 which conveys the superheated steam to vaporizer feed header 9 which also receives fuel oil from line 5. Here again, as in FIG. 1, the oil and steam mixture passes through vaporizer 10 through coil 31 and exits through line 11 with the oil partially vaporized. Burner 10A furnished fuel through fuel oil line 14 makes combustion gases which pass through stack 33 to heat steam superheater coil 38. These combustion gases pass through vaporizer flue gas line 17. Superheater coil 38 surrounds the outer diameter of steam superheater cylinder 39. The flow of combustion gases through stack 33 to heat coil 38 is controlled by steam superheater cylinder damper 40 and vaporizer exhaust damper 41. The amount of hot combustion gases from burner 10A passing over coils 38 can be controlled by opening and closing steam superheater cylinder damper 40. This damper 40 can be controlled by temperature controller 40B on steam superheater line 37 which automatically controls with damper controller 40A. When damper 40 is open more hot gases pass inside cylinder 39 and thus do not heat coil 38. When the temperature of superheated steam in line 37 falls slightly below the control point, the temperature controller 40B calls for damper controller 40A to close damper 40, thus forcing more hot gases outside the cylinder to heat coil 38. Coil 38 could be disposed internally in cylinder 39; in that case the damper would control the opposite way.

Figure 3:
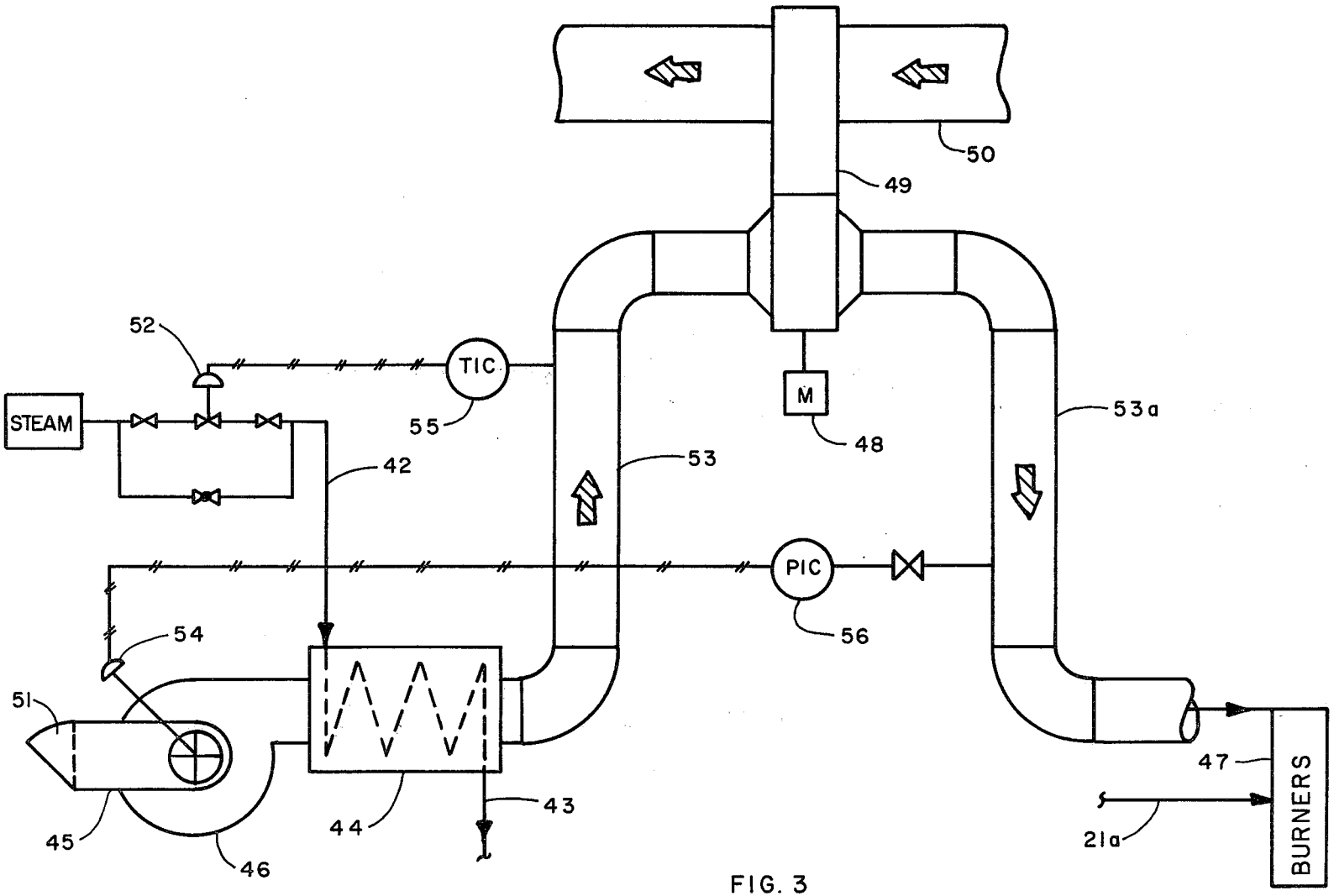
FIG. 3 shows the apparatus and illustrates the method for preheating the combustion air to the burners.

FIG. 3 shows another preferred embodiment of apparatus and method for preheating combustion air to the burners. Burner 47 is fed the heated combustion air through line 53A and the vaporized fuel oil with diluent through line 21A. Air enters the system through intake screen 51 in air intake line 45. Blower 46 blows air through heat exchanger 44, heated by steam through line 42 and exiting line 43. Temperature of the air in line 53 is controlled by temperature indicator controller 55 which automatically controls valve 52 in steam line 42 which furnishes heat to heat exchanger 44. Also, a major source of heat to heat combustion air is the rotating cylinder type gas to gas exchanger 49 in air line 53. This rotating cylinder type heat exchanger 49 can be the Ljungstrom type manufactured by Air Preheater Company. The source of heat is the hot gases in line 50 which can be hot flue gases from any convenient source. These hot flue gases in line 50 heat the rotating cylinder while it is passing through line 50. The rotating cylinder then rotates into line 53 powered by motor 48 and heats the air in line 53. The heater air then passes through line 53A to burner 47. Blower 46 is controlled by pressure indicator controller 56 in heated air line 53A which automatically controls damper controller 54.

Figure 4:
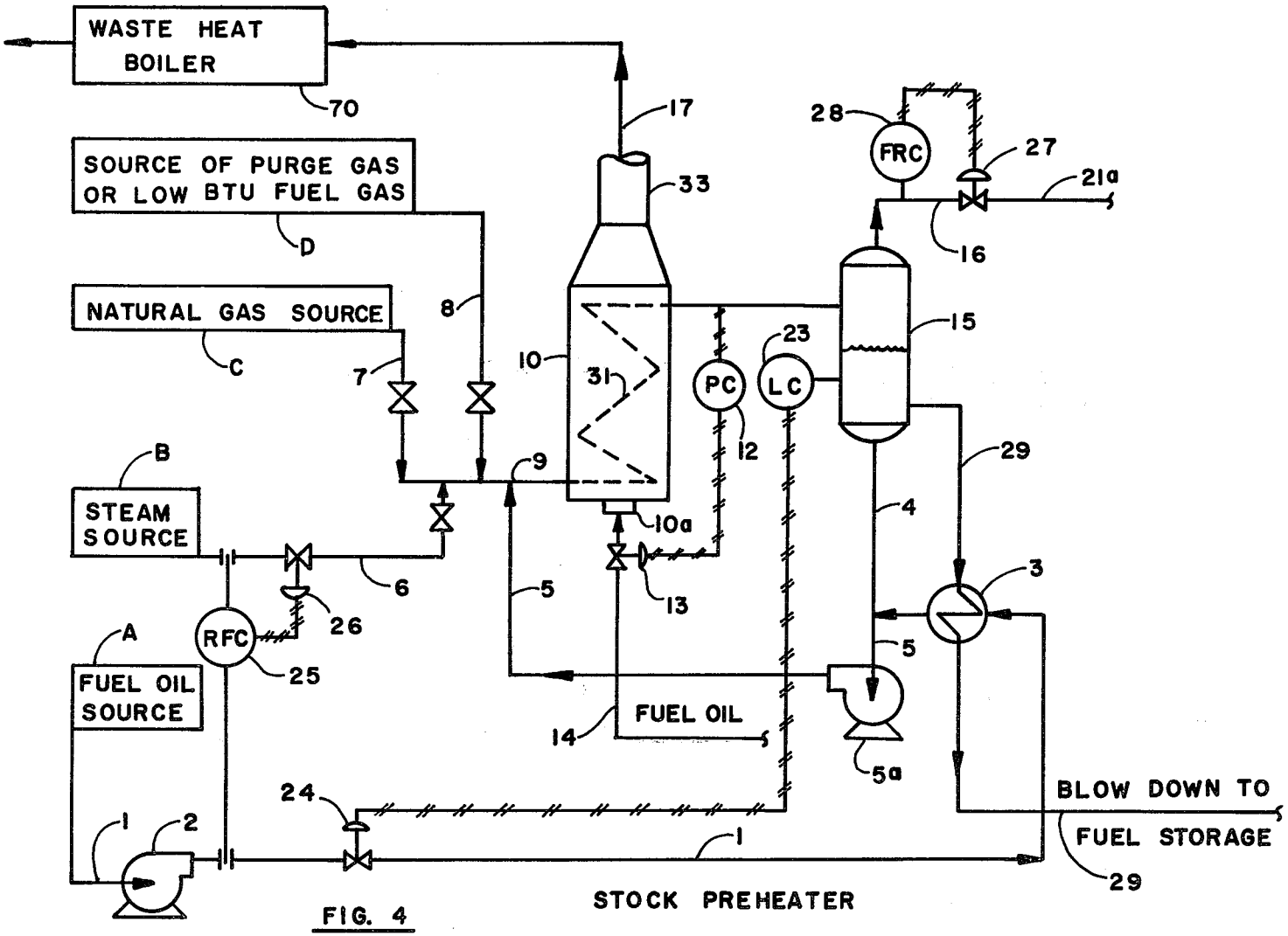
FIG. 4 is a schematic showing the apparatus and illustrating the method of flashing the vapor into the fuel header to the burners without the use of a superheater.

In FIG. 4 the showing of the schematic describing the apparatus and illustrating the method of this invention is the same as in FIG. 1 with like numbers referencing like apparatus. However, in this embodiment the superheater is omitted and the overhead effluent vapor from separator 15 flows through line 16 to be "flashed" across control valve 27 into fuel header line 21A. This "flash" embodiment is possible by using higher temperatures and pressures in the vapor system in lines 11 and 16 and the overhead of separator 15. The increased heat is supplied by vaporizer 10 and pressure is controlled at a higher level by setting pressure control 12 at a higher level, thereby actuating valve 13 in fuel line 14 to burner 10A, until a steady state condition at higher temperature and pressure is achieved.

Figure 5:
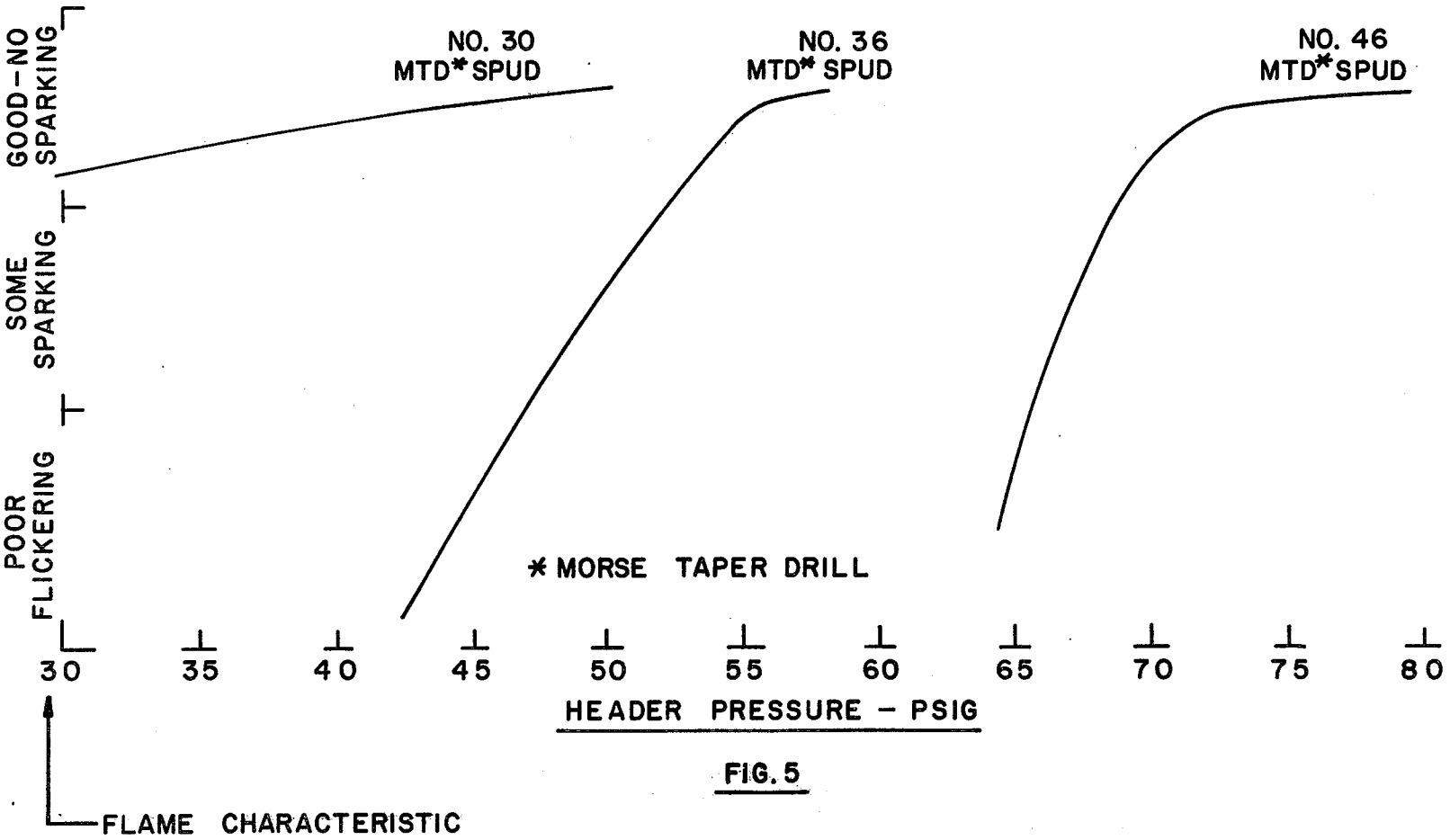
FIG. 5 is a graph showing the relationship of burner pressure and the Morse Taper Drill size of the orifice in the burner spud to flame characteristics.

FIG. 5 graphically shows the relationship of the size of the orifice in the burner spud (when the vapor escapes) and header pressure to flame characteristics. The flame characteristics are shown along the vertical axis, the header pressure in the header piping to the burners is shown along the horizontal axis. The three curves show flame characteristics at various pressures for three different orifice size burner spuds. The orifice sizes are given in Morse Taper Drill (MTD) numbers. The larger the MTD numbers, the smaller the orifice opening in the spud at the burner. The graph is based on a series of actual runs using apparatus similar to that shown in FIG. 1 under conditions varying within or similar to those given in Table A.

The following illustrates, in general, the control method of this invention:

For example, it was demonstrated that a mixture of steam and oil vapor produced a poor sparking flame in a radiant-type burner when the header pressure was about 45 psig. and at a temperature of 700° F. When the header pressure was increased to about 58 psig. a clear, blue flame was produced at the same temperature. A similar condition existed with other burners tested.

The conventional method of vaporizer control provides for regulation of the fuel supply in response to the effluent vapor temperature. This method proved unsatisfactory since variations in feed rates, resulting from a change in furnace heat demand, produced fluctuations in the supply header pressure. An improved control system was developed which maintains any desired pressure at the outlet of the vaporizer in the range indicated above. As shown in FIG. 1, a controller sensor downstream of the vaporizer 10, such as pressure controller 12, is set to regulate the fuel supply, normally gas or fuel oil, for heating the vaporizer unit. By regulation of the firing rate, the set pressure can be maintained for normal variations in vaporizer feed rate corresponding to the furnace fuel demand. If a mixture containing fuel oil and steam is being produced, fuel oil is made up to the system through level control 23 to maintain a constant level in the separator 15. Steam is made up to maintain a uniform composition by means of a ratio flow controller 25. In the system described, any desired pressure may be maintained in the fuel header to provide the required burner performance and allow accurate regulation of fuel flow to the furnace. With the oil circulation system shown, it is also possible to blowdown a predetermined percentage of the oil feed for removal of heavier oil components and oil impurities. This will avoid concentration of these components in the system.

It is also essential to optimum burner performance and to avoid sparking of burners, that the mixture of oil supplied to burners be controlled within a specific temperature range. It is well known that the vapors must be superheated sufficiently that hydrocarbon vapors are not condensed in the fuel header since the presence of liquids will result in incomplete combustion in the burner. It is the function of the superheater 20 to heat the effluent from the vaporizer 10 to the desired superheat temperature. The condensation temperature or dewpoint at any given pressure will vary with the composition of the particular VFO mixture. When producing oil-steam mixtures, this temperature is generally in the range of 550° F. to 600° F. at the normal range of fuel header pressures.

It has been found, however, that burner performance was unsatisfactory as evidenced by excessive sparking unless the mixtures of oil and diluent supplied to the burners are substantially above the dewpoint. The optimum superheat temperature was found to be in the range of 50° F. to 250° F. At superheat temperatures below about 50° F., the performance of some burners was unsatisfactory. At superheat temperatures above 300° F., the overall system costs become excessive since special materials of construction must be employed in the burners and fuel distribution equipment. Also, at higher superheat temperatures, the coking tendency of the mixtures are increased as a result of cracking of heavier hydrocarbons present in the oil. For example, in pilot testing, it was demonstrated that when producing a mixture containing a steam-oil ratio of 0.4 to 1 by weight, the hydrocarbon dewpoint is about 570° F. at a pressure of 85 psig. It was found that burner performance was unsatisfactory when the superheat of the mixture was 56° F. However, when the superheat was increased to 130–140° F., burner sparking was eliminated and excellent flame characteristics were obtained with this radiant-type premix burner.

EXAMPLES

The following examples will further amplify the preferred embodiments of this invention.

In table A below, typical flow rates, temperatures, pressures and ratios are given for various operating parameters and conditions. In Table B below, the run numbers are described by the general mode or parameter being demonstrated. These runs are accomplished in a radiant wall type of heater with a pilot type rig.

TABLE A

| | Run Numbers | | | | | | | | | | | | | | | | | | | |
|---|---|---|---|---|---|---|---|---|---|---|---|---|---|---|---|---|---|---|---|---|
| | 1 | 2 | 3 | 4 | 5 | 6 | 7 | 8 | 9 | 10 | 11 | | 13 | 14 | 15 | 16 | 17 | 18 | 19 | 20 |
| Number of Burners | 6 | 6 | 6 | 5 | 7 | 6 | 6 | 6 | 6 | 6 | 6 | 6 | 6 | 6 | 6 | 6 | 6 | 6 | 6 | 6 |
| Size of Burner Spud, MTD No. | 30 | 30 | 30 | 30 | 32 | 30 | 30 | 30 | 30 | 30 | 30 | 30 | 30 | 30 | 30 | 30 | 30 | 30 | 30 | 30 |
| Oil Flow to Vaporizer, gpm | .4 | .4 | .44 | .4 | .54 | .38 | .38 | .38 | .32 | .32 | .26 | .27 | .29 | .32 | .27 | .19 | .13 | .26 | .23 | .19 |
| Heat Release, Million BTU/hr/burner | .53 | .53 | .53 | .63 | .6 | .5 | .5 | .5 | .42 | .42 | .42 | .42 | .42 | .51 | .43 | .42 | .42 | .42 | .51 | .41 |
| From No. 2 Fuel Oil | .53 | .53 | .33 | .63 | .6 | .5 | .5 | .5 | .42 | .42 | .34 | .35 | .38 | .42 | .36 | .25 | .18 | .34 | .30 | .25 |
| % of Total | 100 | 100 | 100 | 100 | 100 | 100 | 100 | 100 | 100 | 100 | 81 | 84.5 | 90.2 | 83.2 | 82.9 | 59.5 | 42.9 | 81 | 59.9 | 60.9 |
| From Gas | 0 | 0 | 0 | 0 | 0 | 0 | 0 | 0 | 0 | 0 | .08 | .07 | .04 | .09 | .07 | .17 | .24 | .08 | .21 | .16 |
| % of Total | 0 | 0 | 0 | 0 | 0 | 0 | 0 | 0 | 0 | 0 | 19 | 15.5 | 9.8 | 16.8 | 17 | 40.5 | 57.1 | 19 | 40.1 | 39.1 |
| Steam Pressure, psig | 143 | 143 | 146 | 211 | 132 | 141 | 141 | 144 | 145 | 145 | 147 | — | — | — | — | — | — | — | — | — |
| Steam Temperature, ° F. | 720 | 770 | 710 | 745 | 525 | 760 | 920 | 630 | 655 | 680 | 560 | — | — | — | — | — | — | — | — | — |
| Steam to Oil Ratio, lb./lb. | .34 | .34 | .28 | .39 | .43 | .59 | .48 | .38 | .41 | .53 | .3 | — | — | — | — | — | — | — | — | — |
| Temperature at Burner, ° F. | 705 | 734 | 752 | 670 | 734 | 716 | 716 | 704 | 704 | 730 | 730 | 750 | 726 | 688 | 708 | 723 | 728 | 723 | 708 | 704 |
| Pressure at Burner, psig | 42 | 38 | 38 | 42 | 47 | 39 | 31 | 21 | 21 | 26 | 20 | 20 | 15 | 31 | 27 | 18 | 22 | 8 | 21 | 15 |
| TEMPERATURES ° F. | | | | | | | | | | | | | | | | | | | | |
| Inlet Vaporizer | 295 | 295 | 275 | 350 | 315 | 290 | 280 | 260 | 260 | 275 | 220 | — | — | — | — | — | — | — | — | — |
| Outlet Vaporizer | 555 | 540 | 550 | 535 | 580 | 560 | 565 | 510 | 570 | 510 | 500 | 560 | 520 | 520 | 525 | 525 | 570 | 565 | 565 | 565 |
| Inlet Superheater | 480 | 460 | 470 | 410 | 505 | 420 | 420 | 420 | 410 | 425 | 405 | 405 | 405 | 400 | 385 | 390 | 390 | 415 | 385 | 365 |
| Outlet Superheater | 695 | 745 | 740 | 740 | 800 | 820 | 830 | 755 | 810 | 775 | 755 | 750 | 840 | 795 | 705 | 780 | 810 | 835 | 805 | 775 |
| PRESSURES, PSIG | | | | | | | | | | | | | | | | | | | | |
| Steam Header | 154 | 155 | 155 | 221 | 133 | 151 | 151 | 154 | 155 | 152 | 147 | — | — | — | — | — | — | — | — | — |
| Inlet Vaporizer | 72 | 66 | 59 | 185 | 77 | 59 | 52 | 39 | 37 | 42 | 37 | 36 | 26 | 52 | 41 | 30 | 38 | 18 | 33 | 28 |
| Outlet Vaporizer | 56 | 53 | 51 | 172 | 76 | 50 | 42 | 32 | 30 | 36 | 31 | 29 | 20 | 43 | 33 | 23 | 30 | 14 | 27 | 22 |
| Inlet Superheater | 49 | 42 | 40 | 44 | — | 37 | 30 | 21 | 18 | 24 | 22 | 22 | 18 | 30 | 21 | 22 | 23 | — | — | — |
| Outlet Superheater | 42 | 40 | 35 | 38 | 53 | 35 | 29 | 20 | 17 | 24 | 20 | 20 | 15 | 28 | 20 | 22 | 21 | — | 26 | 22 |
| Blowdown, % | 3.5 | 3.5 | 3.5 | 3.5 | 2 | 2—5 | 2—5 | 2—5 | 2—5 | 2—5 | 2—5 | 2—5 | 2—5 | 3.5 | 2— | 2—5 | 2—5 | 3.5 | 3.5 | |
| Recirculation | Yes | Yes | Yes | Yes | No | No | No | No | No | No | No | No | No | Yes | Yes | No | No | No | Yes | Yes |
| Vaporization, % | <97 | <97 | <97 | <97 | 98 | 95—98 | 95—98 | 95—98 | 95—98 | 95—98 | 95—98 | 95—98 | 95—98 | <97 | <97 | 95—98 | 95—98 | 95—98 | <97 | <97 |
| Flame Characteristics* | G | VG | G | G | G | VG | VG | G | G | VG | G | VG | G | G | G | VG | VG | G | G | G |

WG - Good
VG - Very Good

TABLE B

| Run No. | Description | |
|---|---|---|
| 1 | Typical operation of embodiment of FIG. 1 low steam/oil ratio. | 3.5% blowdown with recirculation |
| 2 | Typical operation of embodiment of FIG. 1 low steam/oil ratio. | |
| 3 | Typical operation of embodiment of FIG. 1 low steam/oil ratio. | |
| 4 | Typical operation of embodiment of FIG. 4 medium steam/oil ratio. | |
| 5 | Typical high percent vaporization, 2% blowdown, no recirculation, medium oil/steam ratio. | |
| 6 | Typical high temperature at superheater and burner, 2-5% blowdown, no recirculation, high steam/oil ratio. | |
| 7 | Typical high temperature at superheater and burner, 2-5% blowdown, no recirculation, high steam/oil ratio. | |
| 8 | Typical medium temperature at superheater and burner, 2-5% blowdown, no recirculation, medium steam/oil ratio. | |
| 9 | Typical high temperature at superheater and burner, low pressure superheater and burner, medium steam/oil ratio. | |
| 10 | Typical medium temperature at superheater and burner, low pressure superheater and burner, high steam/oil ratio. | |
| 11 | Steam and gas and oil operation, 2-5% blowdown, no recirculation. | |
| 12 | No steam, oil and purge gas, 2-5% blowdown, no recirculation, 84% heat from fuel oil. | |
| 13 | No steam, oil and purge gas, 2-5% blowdown, no recirculation, 90% heat from fuel oil. | |
| 14 | No steam, purge gas operation, 2-5% blowdown, no recirculation. | |
| 15 | No steam, purge gas operation, 2-5% blowdown, no recirculation. | |
| 16 | No steam, oil and natural gas, 2-5% blowdown, no recirculation. 60% heat from fuel oil. | |
| 17 | No steam, oil and natural gas, 2-5% blowdown, no recirculation, 43% heat from fuel oil. | |
| 18 | No steam, oil and natural gas, 2-5% blowdown, no recirculation, 81% heat from fuel oil. | |
| 19 | No steam, natural gas operation, 2-5% blowdown, no recirculation. | |
| 20 | No steam, natural gas operation, 2-5% blowdown, no recirculation, and low pressure at superheater and burner. | |

Run numbers 11 to 20 uses a gas as diluent. Run numbers 12 to 20 uses no steam as diluent.
Run numbers 11 and 16 to 20 uses natural gas. Run numbers 12 to 15 uses purge gas. All runs are made in a radiant wall reformer heater, with burners originally designed for natural gas.
In order to overcome ambient (14° F. and lower) winter temperatures, electric current is passed through the metal of the burner header piping to cause impedance heating, set at 750° F.

The following tables C to F are runs using the embodiment with a superheater and to demonstrate as noted in the tables. Although at certain times the forced air system, formerly used for the gas burner caused insufficient oxygen, the runs in general successfully proved the operability of the process. Those runs wherein a bad flame was obtained are omitted, whether for insufficient air or other reasons. These runs are accomplished in a portion of a terraced wall reformer with a special pilot rig.

TABLE C

20% PURGE GAS TESTS

| Test No. | Conditions MM BTU per Burner / Special Condition | Gas scfh | Gas lb./hr. | Steam lb./hr. | Oil gpm | Oil lb./hr. | Steam/Oil | % Vaporized | Burner psig | Burner ° F | Flame |
|---|---|---|---|---|---|---|---|---|---|---|---|
| 3-11-1 | 2.40/Burner Normal Rate | 3093 | 84.4 | 0 | .49 | 207 | — | 97.6 | 21 | 695 | ok Good 6-7" off wall |
| 3-12-1 | 1.02 Minimum Rate | 1257 | 34.3 | 0 | .21 | 89 | — | 98.0 | 4 | 735 | ok 1" high, clear yellow |
| 3-12-4 | 2.39 | 3093 | 84.4 | 0 | .54 | 228 | — | 88.2 | 19 | 760 | ok 5-6" up, clear yellow |
| 3-25-2 | 1.81 New Burner | 2900 | 79.2 | 0 | .46 | 194 | — | 98.0 est. | 15 | 695 | ok 5-6" yellow and blue |
| 4-1-4 | 2.06 | 2900 | 79.2 | — | .40 | 169 | — | 100.0 | 13 | 710 | Good short blue flame |
| 4-1-5 | 1.98 With steam | 2900 | 79.2 | 37 | .40 | 169 | .22 | 94.3 | 16 | 720 | ok No flashes short blue flame |

TABLE D

10% PURGE GAS TESTS

| Test No. | Conditions MM BTU per Burner / Special Condition | Gas scfh | Gas lb./hr | Steam lb./hr. | Oil gpm | Oil lb./hr. | Steam/Oil | % Vaporized | Burner psig | Burner ° F | Flame |
|---|---|---|---|---|---|---|---|---|---|---|---|
| 3-11-3 | 2.00 With steam | 1547 | 42.2 | 23 | .55 | 233.0 | .10 | 80.2 | 12 | 725 | ok 3-4" yellow, flickering 8-10" |
| 3-11-6 | 2.03 Moderate with steam | 1835 | 50.1 | 23 | .63 | 267.0 | .09 | 69.5 | 13 | 690 | ok 6-6" yellow |
| 3-11-7 | 2.00 High rate with steam | 1835 | 50.1 | 33 | .63 | 267.0 | .12 | 71.4 | 18 | 720 | ok 6-7" yellow, flickering |
| 3-12-2 | .99 Low Rate | 579 | 15.8 | — | .23 | 97.6 | — | 98.0 est. | 2 | 735 | ok −1", stiff yellow |
| 3-12-3 | .79 Low Rate with Steam | 579 | 15.8 | 28 | .23 | 97.6 | .29 | 98.0 est. | 10 | 760 | ok −1", blue |
| 3-12-8 | 2.25 Normal temperature | 1547 | 42.2 | 27 | .61 | 259.0 | .10 | 82.6 | 18 | 710 | ok 5-6" stiff yellow |

TABLE D-continued

10% PURGE GAS TESTS

| Test No. | Conditions MM BTU per Burner / Special Condition | Gas scfh | Gas lb./hr | Steam lb./hr. | Oil gpm | Oil lb./hr. | Steam/Oil | % Vaporized | Burner psig | Burner ° F | Flame |
|---|---|---|---|---|---|---|---|---|---|---|---|
| 3-25-1 | 2.24 Demonstration | 1451 | 39.6 | 33 | .52 | 221.0 | .15 | 97.0 est. | 12 | 662 | ok |
| 3-25-4 | 2.17 Steam maximum | 1451 | 39.6 | 23 | .52 | 221 | .10 | 94.0 est. | 10 | 685 | ok 4–6" blue with yellow top |
| 3-29-1 | 2.07 Check blowdown | 1451 | 39.6 | 33 | .52 | 221 | .14 | 89.0 | 9 | 708 | ok 4–6" yellow, flashes to 10" |
| 3-29-2 | 2.26 Fine 5% blowdown | 1451 | 39.6 | 33 | .52 | 221 | .14 | 98.2 | 10 | 700 | ok 6–7" yellow, much flashing |
| 3-29-3 | 2.12 | 1451 | 39.6 | 33 | .52 | 221 | .14 | 91.4 | 10 | 755 | ok 4–6" yellow |
| 3-29-4 | 2.15 | 1451 | 39.6 | 33 | .52 | 221 | .14 | 92.8 | 10 | 758 | ok 4–6" yellow |
| 3-29-5 | 2.09 | 1451 | 39.6 | 33 | .52 | 221 | .14 | 90.0 est. | 10 | 760 | ok 5–7" yellow |
| 3-29-6 | 2.12 | 1451 | 39.6 | 33 | .52 | 221 | .14 | 91.4 | 10 | 760 | ok 5–7" yellow |
| 3-30-5A | 2.28 Low steam | 1451 | 39.6 | 25 | .52 | 221 | .11 | 99.0 | 14 | 785 | ok 2–3" clear, yellow to white |
| 3-31-1 | 1.99 Turndown | 1256 | 34.3 | 23 | .48 | 204 | .11 | 93.9 | 11 | 740 | ok 4–6" yellow, flashes |
| 3-31-2 | 1.61 | 967 | 26.4 | 29 | .39 | 165 | .18 | 94.3 | 7 | 740 | ok 3–4" yellow, flashes |
| 3-31-3 | 1.06 | 579 | 15.8 | 29 | .25 | 106 | .28 | 97.6 | 4 | 720 | ok 1–2" yellow, flashes |
| 4-1-1 | 2.19 Continuous test | 1451 | 39.6 | 36 | .52 | 221 | .16 | 95.0 | 13 | 705 | ok 3–4" blue and yellow |
| 4-1-2 | 2.22 | 1451 | 39.6 | 36 | .52 | 221 | .16 | 96.0 | 13 | 720 | ok 3–4" blue with yellow |
| Average of 107 Hour Test: 1.95 MM BTUH/Burner | | 1547 | 42.2 | 36 | .45 | 191 | .19 | 95.0 | 11 | 713 | |

TABLE E

NATURAL GAS TESTS

| Test No. | Conditions MM BTU per Burner / Special Condition | Gas scfh | Gas lb./hr. | Steam lb./hr. | Oil gpm | Oil lb./hr. | Steam/Oil | % Vaporized | Burner psig | Burner ° F | Flame |
|---|---|---|---|---|---|---|---|---|---|---|---|
| 3-15-1 | 2.33 MM/Burner 86% NG* Start for Minimum Oil | 3366 | 169 | — | .21 | 89 | — | 96.0 est. | 9 | 720 | ok 4–5", blue, trace of yellow |
| 3-15-2 | 2.44 77.0% NG | 4105 | 206 | — | .15 | 64 | — | 96.0 est. | 10 | 735 | ok 3–4", blue and transparent |
| 3-15-3 | 2.44 77% NG | 4105 | 206 | 28 | .15 | 64 | .44 | 96.0 est. | 14 | 690 | ok 3–4", blue |
| 3-15-4 | 2.31 42% NG | 4689 | 234 | — | .05 | 21 | — | 98.0 est. | 16 | 710 | ok 1–2", blue |
| 3-15-5 | 2.28 53% NG Start for Minimum Gas | 2627 | 132 | — | .28 | 119 | — | 98.0 est. | 8 | 710 | ok 6–7", clear yellow |
| 3-15-6 | 2.24 37% NG | 1806 | 90 | — | .37 | 157 | — | 98.0 est. | 5 | 720 | ok No impingement 6–7", yellow, billowy |
| 3-16-2 | 2.16 55% NG | 2627 | 132 | — | .25 | 106 | — | 98.0 est. | 10 | 710 | ok 5–6", partially clear |
| 3-16-3 | 2.28 53% NG | 2627 | 132 | — | .28 | 119 | — | 98.0 est. | 10 | 680 | ok 7–8", partially clear |
| 3-16-4 | 2.28 53% NG | 2627 | 132 | — | .28 | 119 | — | 98.0 est. | 10 | 660 | ok 7–8", partially clear |
| 3-16-5 | 2.28 53% NG | 2627 | 132 | — | .28 | 119 | — | 98.0 est. | 8 | 635 | ok 7–8", partially clear |
| 3-16-6 | 2.28 53% NG | 2627 | 132 | — | .28 | 119 | — | 98.0 est. | 8 | 670 | No change |
| 3-16-7 | 2.28 53% NG | 2627 | 132 | — | .28 | 119 | — | 98.0 est. | 7 | 610 | ok, slightly more yellow |
| 3-16-8 | 2.28 53% NG | 2627 | 132 | — | .28 | 119 | — | 99.0 est. | 7 | 525 | ok, more yellow |
| 3-17-1 | 1.14 36% NG Low rate, 50% | 903 | 45 | — | .19 | 81 | — | 98.0 est. | 2 | 640 | ok 2–3", yellow |
| 3-17-2 | .80 42% NG Low Rate 40% | 739 | 37 | — | .12 | 51 | — | 98.0 est. | 1 | 640 | ok 1–2", yellow |
| 3-17-3 | 1.68 36% NG 75% Rate | 1313 | 66 | — | .28 | 119 | — | 98.0 | 3 | 675 | ok 3–4", yellow and transparent |
| 3-17-4 | 1.95 | 1560 | 78 | — | .33 | 140 | — | 96.0 | 4 | 710 | ok |

TABLE E-continued

NATURAL GAS TESTS

| Test No. | Conditions MM BTU per Burner Special Condition | Gas scfh | Gas lb./hr. | Steam lb./hr. | Oil gpm | Oil lb./hr. | Steam/Oil | % Vaporized | Burner psig | Burner ° F | Flame |
|---|---|---|---|---|---|---|---|---|---|---|---|
| 3-17-7 | 36% NG 90% Rate 2.69 MM/Burner | 4769 | 214 | — | .20 | 85 | — | 95.0 | 10 | 650 | 5-6", yellow and transparent ok |
| 3-17-8 | 72% NG High rate, maximum gas 2.73 | 5918 | 271 | — | .07 | 30 | — | 95.0 | 13 | 640 | 4-5", blue with clear ok |
| 3-17-9 | 90% NG High rate, maximum gas 2.52 | 1806 | 90 | 30 | .48 | 204 | .15 | 90.1 | 9 | 660 | 4-5%, blue with yellow ok |
| 3-17-10 | 33% NG Average steam 2.57 | 1806 | 90 | 60 | .48 | 204 | .29 | 92.6 | 11 | 650 | 5-6", clear with yellow ok |
| 3-18-2 | 32% NG More steam 2.40 | 575 | 29 | 80 | .61 | 259 | .31 | 88.9 | 9 | 640 | 6-7", blue bottom yellow top ok |
| 3-18-3 | 11% NG More steam 2.33 | 575 | 29 | 135 | .61 | 259 | .52 | 86.1 | 12 | 660 | 6-7", clear yellow ok |
| | 11% NG Still more steam | | | | | | | | | | 2-3", blue with yellow |

*natural gas

TABLE F

100% OIL TESTS

| Test No. | Conditions MM BTU per Burner Special Condition | Steam lb./hr. | Oil gpm | Oil lb./hr. | Steam/Oil | % Vaporized | Burner psig | Burner ° F | Flame |
|---|---|---|---|---|---|---|---|---|---|
| 3-17-6 | 2.09 MM/Burner One burner | 53 | .28 | 119 | .45 | 94.9 | 8 | 700 | ok 4-6", blue |
| 3-18-4 | 2.64 Find minimum steam | 185 | .70 | 297 | .62 | 96.1 | 14 | 652 | ok 7-8", blue with yellow |
| 3-18-6 | 2.24 | 120 | .58 | 246 | .79 | 98.5 | 9 | 685 | ok 7-8", clear yellow |
| 3-18-7 | 2.26 | 160 | .58 | 246 | .65 | 99.0 | 12 | 670 | ok 5-6", blue, yellow streaks |
| 3-18-8 | 2.26 | 190 190 | .58 | 246 | .77 | 99.0 | 14 | 655 | ok 3-7", blue, yellow streaks |
| 3-19-1 | 2.20 | 80 | .57 | 242 | .33 | 98.0 | 6 | 670 | ok 5-6", blue, yellow |
| 3-19-3 | 2.17 | 50 | .57 | 242 | .21 | 96.7 | 4 | 675 | ok 4-5", stiff, yellow |
| 3-24-4 | 2.18 One burner (modified) | 52 | .28 | 119 | .44 | 99.0 est. | 14 | 725 | ok 2-3", blue flame |
| 3-24-6 | 2.18 One burner, minimum steam | 49 | .28 | 119 | .41 | 99.0 est. | 13 | 740 | ok 8", yellow with blue |
| 3-24-7 | 2.22 Two burners | 80 | .57 | 242 | .33 | 99.0 est. | 10 | 756 | ok 6-8", yellow with blue |
| 3-25-6 | 2.17 Burner position fix | 67 | .57 | 242 | .28 | 96.6 | 8 | 720 | ok 6-7", yellow, some flickering |
| 3-25-7 | 2.19 More steam | 87 | .57 | 242 | .36 | 97.7 | 11 | 735 | ok 4-6", yellow and blue |
| 3-26-2 | 2.51 Cold air on #3 burner, more steam | 53 | .76 | 322 | .16 | 84.0 | 8 | 705 | #3 ok, 4-6"stiff yellow and blue; #5 out of air, impinging |

We claim:

1. A method to replace natural gas with vaporized fuel oil for burning in at least one natural gas burner without major modifications to said burner, comprising mixing fuel oil with a gaseous diluent, then vaporizing a portion of said fuel oil in said mixture of fuel oil and diluent in a vaporizer, then separating the vapor portion from the liquid portion of said partially vaporized fuel oil as overhead effluent in a separator, while maintaining said overhead effluent vapor at a high temperature and pressure with heat from said vaporizer, and controlling the temperature, pressure and/or flow rates of said mixing, vaporizing and separating by a. automatically controlling the flow of said fuel oil with a liquid level controller sensing the liquid level in said separator, b. automatically controlling the flow of said diluent with a ratio flow controller sensing the flow of said fuel oil and of said diluent to said vaporizer to control said flow of said diluent to a set ratio of said flow of said fuel oil, and c. automatically controlling the vaporizing heat input to said vaporizer with a pressure controller sensing the pressures of the vaporizer outlet and separator overhead, and d. controlling the flow of said separator overhead with a valve, so that said separator overhead effluent mixture of diluted fuel oil vapor flashes to a lower temperature and pressure downstream of said valve controlling said separator overhead flow.

2. The method of claim 1 wherein said valve controlling the flow of the separator overhead is automatically controlled.

3. The method of claim 2 wherein said control is by a set flow controller.

4. The method of claim 1 wherein said mixture of said vaporized fuel and diluent exiting said control valve is maintained at a temperature of between about 50° F. to 300° F. above the dewpoint of the mixture, said separation and vaporization being maintained at a pressure of between about 75 to 150 psig. above the pressure downstream of said valve controlling said separator overhead, and said mixture is burned in said burner.

5. The method of claim 4 wherein at least a portion of the liquid unvaporized fuel oil is drawn off to storage in order to remove nonvaporized accumulated metals and sulfur impurities contained therein.

6. A method to replace natural gas with vaporized fuel oil for burning in at least one natural gas burner, without major modifications to said burner, comprising mixing fuel oil with a gaseous diluent, then vaporizing a portion of said fuel oil in said mixture of fuel oil and diluent in a vaporizer, then separating the vapor portion from the liquid portion of said partially vaporized fuel oil as overhead effluent in a separator, then superheating said overhead effluent from said separator, while controlling the temperature, pressure and/or flow rates of said mixing, vaporizing, separating, and superheating by a. automatically controlling the flow of said fuel oil with a liquid level controller sensing the liquid level in said separator, b. automatically controlling the flow of said diluent with a ratio flow controller sensing the flow of said fuel oil and of said diluent to said vaporizer to control said flow of said diluent to a set ratio of said flow of said fuel oil, c. automatically controlling the vaporizing heat input to said vaporizer with a pressure controller sensing the pressures of the vaporizer outlet and separator overhead, and d. controlling the flow of said superheater effluent with a valve.

7. The method of claim 6 wherein said valve controlling the flow of the superheater effluent is automatically controlled.

8. The method of claim 7 wherein said control is by a set flow controller.

9. The method of claim 6 wherein said controlling also comprises automatically controlling the heat input to said superheater with a temperature controller sensing the temperature of said superheater overhead effluent.

10. The method of claim 7 wherein said superheating is carried out to heat said overhead effluent from said superheater to a temperature of between about 50° F. to 300° F. above the dewpoint of said overhead effluent from said separator, and said effluent from said superheater is burned in said burner.

11. The method of claim 9 wherein said temperature is between about 200° F. to 275° F. above the dewpoint.

12. The method of claim 9 wherein said superheating takes place at a pressure of between about 15 to 85 psig.

13. The method of claim 12 wherein the pressure downstream of said valve automatically controlling the flow of said superheater effluent is steady at a value of between about 5 to 80 psig.

14. The method of claim 13 wherein said valve automatically controlling the flow of said superheater effluent is controlled by a flow recorder-controller set to sense the automatically control said flow.

15. The method of claim 13 wherein said diluent is selected from the group consisting of steam, natural gas, purge gas, low Btu fuel gas, and mixtures thereof.

16. The method of claim 15 wherein said diluent is steam.

17. The method of claim 15 wherein combustion air supplied to said natural gas burner is preheated.

18. The method of claim 11 wherein combustion air supplied to said natural gas burner is preheated.

19. The method of claim 18 wherein said preheating is accomplished by heat exchange with waste heat.

20. The method of claim 19 wherein said waste heat is from combustion gases from burned fuel.

21. The method of claim 20 wherein said combustion gases are flue gases from said natural gas burner.

22. The method of claim 9 wherein said diluent is also superheated.

23. The method of claim 22 wherein said superheating is accomplished by heat exchange with waste heat from said vaporizer, at least a portion of the liquid unvaporized fuel oil in said separator is drawn off to storage in order to remove accumulated metal and sulfur impurities contained therein, and another portion of the liquid unvaporized fuel oil in said separator is recycled to pass through said vaporizer.

24. The method of claim 23 wherein said vaporizing is accomplished by burning a fuel, and said heat exchange is accomplished by passing hot combustion gases, from said burning to heat said vaporizer, across a heat exchanger.

25. The method of claim 24 wherein said heat exchanger is a coil in the vaporizer exhaust stack.

26. The method of claim 25 wherein said heat exchanger is a coil disposed around a cylinder in said exhaust stack, said cylinder having an internal damper, and automatically controlling the temperature of said superheated diluent is accomplished by sensing its temperature with a temperature controller which automatically opens and closes said damper.

27. The method of claim 6 wherein at least a portion of the liquid unvaporized fuel oil in said separator is drawn off to storage in order to remove nonvaporized accumulated metals and sulfur impurities contained therein.

28. The method of claim 27 wherein another portion of the liquid unvaporized fuel oil in said separator is recycled to pass through said vaporizer.

29. An apparatus to replace natural gas with vaporized fuel oil, whereby fuel oil is mixed with a gaseous diluent and partially vaporized to burn in at least one natural gas burner without major modifications to said burner, comprising an oil vaporizer, a gas-liquid separator, a source of fuel oil under pressure,
a source of diluent under pressure,
a source of heat for said vaporizer, and
a control system to control the temperature, pressure and/or flow rates into and out of said vaporizer and said separator, said fuel oil and diluent being admixed and introduced into said vaporizer, the effluent from said vaporizer being introduced into said separator, and the overhead effluent from said separator being burned in said burner, said control system comprising a liquid level controller sensing the liquid level in said separator to automatically control the flow of said fuel oil to said vaporizer,
a ratio flow controller sensing the flow of said fuel oil and of said diluent to said vaporizer to automatically control said flow of said diluent to a set ratio of said flow of said fuel oil,
a pressure controller sensing the pressure at the vaporizer outlet and separator overhead to automatically control the heat input to said vaporizer, and
a flow control valve set to automatically control the flow of said separator overhead to said burner.

30. The apparatus of claim 29 wherein the combustion air to said natural gas burner is preheated with a preheater.

31. An apparatus to replace natural gas with vaporized fuel oil, whereby fuel oil is mixed with a gaseous diluent and partially vaporized to burn in at least one speed equipped natural gas burner without major modifications, comprising a source of fuel oil under pressure,
a source of diluent under pressure,
an oil vaporizer,
a gas-liquid separator,
a vaporizer effluent superheater,
a source of heat for said vaporizer,
a source of heat for said superheater, and
a control system to control the temperature, pressure and/or flow rates into and out of said vaporizer, separator, and superheater, said fuel oil and diluent being admixed and introduced into said vaporizer with the effluent from said vaporizer being introduced into said separator, the overhead effluent vapor from said separator being introduced into said superheater and effluent from said superheater being burned in said burner, said control system comprising a liquid level controller sensing the level of liquid in said separator to automatically control the flow of said fuel oil to said vaporizer,
a ratio flow controller sensing the flow of said fuel oil and of said diluent to said vaporizer to automatically control said flow of said diluent to a set ratio of said flow of said fuel oil,
a pressure controller sensing the pressure at the vaporizer outlet and separator overhead to automatically control the vaporizing heat out to said vaporizer,
a flow recorder controller set to automatically control the flow of vapor effluent from said superheater to said burner with a control valve.

32. The apparatus of claim 31 wherein a part of said control system is a temperature controller sensing the temperature of the superheater vapor effluent to automatically control the heat input into said superheater.

33. The apparatus of claim 32 wherein the combustion air to said natural gas burner is preheated with a preheater.

34. The apparatus of claim 31 wherein said apparatus also comprises a diluent superheater.

35. The apparatus of claim 34 wherein the combustion air to said natural gas burner is preheated with a preheater.

36. The apparatus of claim 31 wherein said diluents are selected from the group consisting of steam, natural gas, purge gas, low Btu fuel gas, and mixtures thereof.

37. The apparatus of claim 36 wherein said diluent is steam.

38. The apparatus of claim 31 wherein the combustion air to said natural gas burner is preheated with a preheater.

39. The apparatus of claim 31 wherein the spud in said natural gas burner has a Morse Taper Drill number of 30 or less.

40. The apparatus of claim 31 wherein the pressure downstream of said automatically controlled valve controlling the flow of vapor effluent from said superheater is above 50 psig., and the Morse Taper Drill number of said spud in said natural gas burner is 36 or smaller.

41. The apparatus of claim 40 wherein said pressure is above 67 psig. and the Morse Taper Drill of said spud is 46 or smaller.

* * * * *

UNITED STATES PATENT AND TRADEMARK OFFICE

CERTIFICATE OF CORRECTION

PATENT NO. : 4,140,473

DATED : February 20, 1979

INVENTOR(S) : W. W. Hoehing, J. M. Jackson, and E. R. Johnson

It is certified that error appears in the above-identified patent and that said Letters Patent are hereby corrected as shown below:

Column 1, line 34, "liquid" should read -- liquid --;

Column 1, line 43, "or" should read -- for --.

Table A, under the subheading "Run Numbers", following "11", insert -- 12 --;

Table A, in the line labeled "Blowdown, %" between Columns 13 and 14, omit "3.5";

in Column 15, "2-" should read -- 3.5 --;

in Column 18, "3.5" should read -- 2- --;

in Column 20, following "22", insert -- 3.5 --;

Table A, "WG" should read -- *G --.

UNITED STATES PATENT AND TRADEMARK OFFICE

CERTIFICATE OF CORRECTION

PATENT NO. : 4,140,473

DATED : February 20, 1979

INVENTOR(S) : W. W. Hoehing, J. M. Jackson, and E. R. Johnson

It is certified that error appears in the above-identified patent and that said Letters Patent are hereby corrected as shown below:

Table C, in the subheading, "Steam" should read -- Steam --.

Table D, in the subheading, "Steam" should read -- Steam --;

Table D, under the subheading "Burner", under the category "Flame", "6-6"" should read -- 6-7" --.

Column 19, line 23, following "oil", insert -- in said separator --.

Column 20, line 4, "200°F" should read -- 100°F --.

Signed and Sealed this

*Sixteenth* Day of *October 1979*

[SEAL]

*Attest:*

RUTH C. MASON
*Attesting Officer*

LUTRELLE F. PARKER
*Acting Commissioner of Patents and Trademarks*

UNITED STATES PATENT AND TRADEMARK OFFICE

CERTIFICATE OF CORRECTION

PATENT NO. : 4,140,473

DATED : February 20, 1979

INVENTOR(S) : W. W. Hoehing, J. M. Jackson, and E. R. Johnson

It is certified that error appears in the above-identified patent and that said Letters Patent are hereby corrected as shown below:

On the title page, under "References Cited U.S. PATENT DOCUMENTS" add the following:

| | | | |
|---|---|---|---|
| 1,747,375 | 2/1930 | Mallery | 431/4 |
| 1,761,537 | 6/1930 | Ravenor | 431/11 |
| 1,832,280 | 11/1931 | Coultas | 431/4 |
| 2,866,602 | 12/1958 | Dailey, Jr. et al. | 431/12 |
| 3,291,191 | 12/1966 | Stoops | 431/11 |
| 3,314,879 | 4/1967 | Lacy et al. | 208/361 |
| 3,384,576 | 5/1968 | Greco | 208/361 |
| 3,444,052 | 5/1969 | Bracken et al. | 203/88X |

UNITED STATES PATENT AND TRADEMARK OFFICE

CERTIFICATE OF CORRECTION

PATENT NO. : 4,140,473

DATED : February 20, 1979

INVENTOR(S) : W. W. Hoehing, J. M. Jackson, and E. R. Johnson

It is certified that error appears in the above–identified patent and that said Letters Patent are hereby corrected as shown below:

| | | | |
|---|---|---|---|
| 3,561,895 | 2/1971 | Michelson | 431/89X |
| 3,614,282 | 10/1971 | Gabor | 431/11X |
| 3,734,675 | 5/1973 | Osburn | 431/12 |

Signed and Sealed this

*Eleventh* Day of *December 1979*

[SEAL]

*Attest:*

SIDNEY A. DIAMOND

*Attesting Officer*

*Commissioner of Patents and Trademarks*